US005983453A

United States Patent [19]

Miwa

[11] Patent Number: 5,983,453

[45] Date of Patent: Nov. 16, 1999

[54] DOOR OPERATION MECHANISM

[75] Inventor: Minoru Miwa, Komaki, Japan

[73] Assignee: Aiwalite Co., Inc., Nagoya, Japan

[21] Appl. No.: 09/067,292

[22] Filed: Apr. 27, 1998

[30] Foreign Application Priority Data

Oct. 11, 1997 [JP] Japan ..... 9-307169

[51] Int. Cl.[6] ..... E05D 15/50

[52] U.S. Cl. ..... 16/231; 49/193; 312/324

[58] Field of Search ..... 16/230–232, DIG. 23; 49/193; 312/324, 328

[56] References Cited

U.S. PATENT DOCUMENTS

| | | | |
|---|---|---|---|
| 3,048,898 | 8/1962 | David | 16/232 |
| 3,889,419 | 6/1975 | Maleck | 49/193 |
| 4,503,584 | 3/1985 | Malchow | 16/232 |
| 4,811,518 | 3/1989 | Ladisa | 49/193 |
| 5,173,992 | 12/1992 | Aihara et al. | 16/232 |
| 5,187,836 | 2/1993 | Kim et al. | 16/231 |
| 5,357,652 | 10/1994 | Yamada | 16/232 |
| 5,548,927 | 8/1996 | Song | 49/193 |

*Primary Examiner*—Chuck Y. Mah
*Attorney, Agent, or Firm*—Davis and Bujold

[57] ABSTRACT

There is disclosed a door operation mechanism which can open/close a door to either right or left side. When a handle portion 116 is manually pivoted and displaced, it rotates cams 98 and 98*a* and, thus, a thrust-up rod 94 is pushed up and a push-down rod 94*a* is pushed down. The thrust-up rod 94 pushes and displaces a swing plate 66 in a hinge mechanism 16*a*. The push-down rod 94*a* pushes and displaces a swing place 66 in a hinge mechanism 16*b*. Then, the swing plates 66 in the hinge mechanisms 16*a* and 16*b* fail to bind hinge pins 22 and 26, respectively, and the right side of a door 14 is released. By pulling the right side of the door 14, the door 14 can be opened on the axis of hinge mechanisms 16*c* and 16*d* which are provided on the left side of the door. On the other hand, when a left unlocking mechanism 20*b* is operated, the door 14 can be opened on the axis of the hinge mechanisms 16*a* and 16*b* on the right side of the door. Therefore, the door 14 can be opened to either right or left side.

6 Claims, 8 Drawing Sheets

FIG. 5A
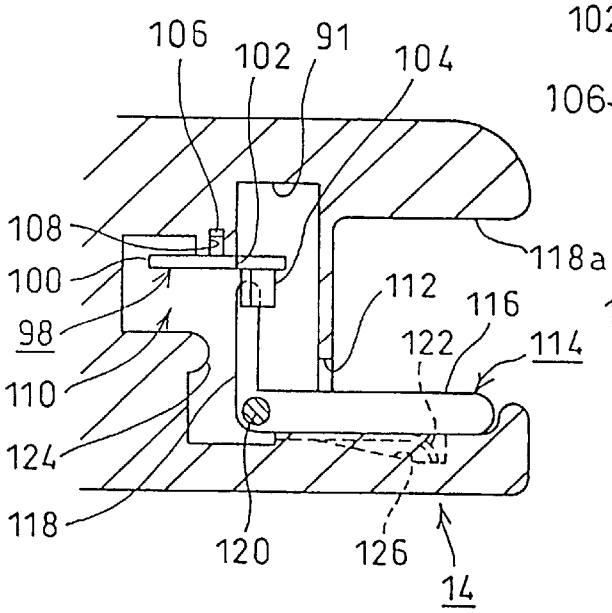
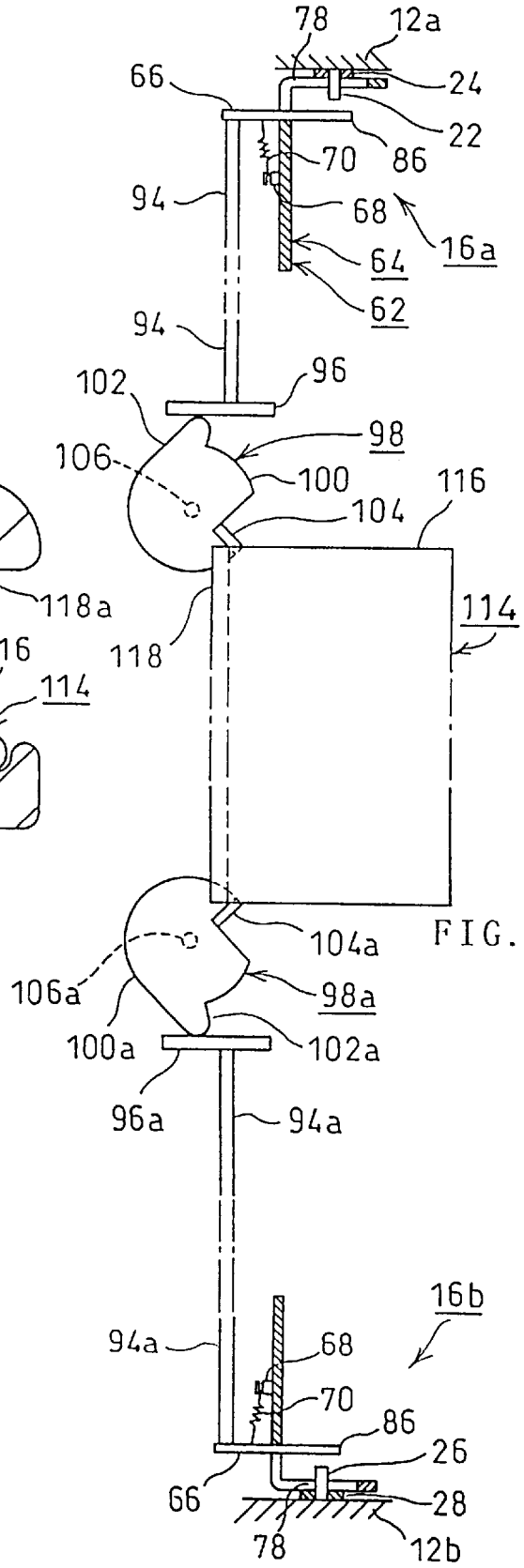
FIG. 5B

DOOR OPERATION MECHANISM

BACKGROUND OF THE INVENTION

The present invention relates to a door operation mechanism for opening/closing a door.

In a conventional constitution, a furniture door or another door is interconnected on the left or right side with a body by a hinge or the like on which the door swings to open or close.

In this constitution, an object which interferes with a door cannot be placed in a range in which the door opens/closes. Also, in the case of a furniture door, the left or right side of the door needs to be positioned spaced from a wall in such a manner that the door is prevented from contacting the wall.

Additionally, in the case where doors are arranged in, for example, a locker room, when the locker doors open to the left side, one hesitates to or cannot easily open the door if the left-side locker is being used by another person. In this case, one waits for the neighboring person to leave before opening the door or carefully opens the door in such a manner that the door does not hit the neighboring person.

When the opening direction of the door is fixed in this manner, the aforementioned disadvantages are caused.

SUMMARY OF THE INVENTION

An object of the present invention is to provide a door operation mechanism which can open or close a door to either side.

To attain this and other objects, the invention provides a door operation mechanism for opening/closing a door which is opened/closed relative to a box-like or frame-like body having a rectangular opening in a front face.

According to the invention there is provided at door operating mechanism for opening/closing a door which is opened/closed relative to structure, the structure defining two pairs vertically opposed hinge pins defining two hinge pins, one on each of right and left sides of the structure, the door comprising:

four bearing latch assemblies, one for each hinge pin, each having a pin insertion groove, having sufficient width for passing one of the hinge pins, an open end adjacent the structure and a closed end remote from the structure;

each assembly having a regulating member provided in its pin insertion grooves each regulating member being displaceable between an unlocking position in which the associated hinge pin passes through the closed end of the pin insertion groove and is prevented from moving toward the open end thereof and a release position in which the hinge pin is free to move toward the open end, each regulating member being biased to the unlocking position by a biasing member, and each regulating member being displaced by the hinge pin, when the hinge pin is relatively moved from the open end toward the closed end, to the release position against a biasing force of the biasing member to allow the hinge pin to pass along the pin insertion groove toward the closed end thereof;

a right-side door opening means provided on the right side of the door displaceable from a closed door position to an opened door position, by an external force for opening the door, to displace the regulating members provided on the right side of the door to the release position; and a left-side door opening means provided on the left side of the door displaceable from the closed door position to the opened door position, by the external force for opening the door, to displace the regulating members provided on the left side of the door to the release position.

Preferably, the bearing latch assembly further comprises:

a bearing body defining the pin insertion groove;

the regulating member being a swing plate having a first and second ends, the swing plate being pivotally supported by the bearing body within the pin insertion groove;

the biasing member being a tension coil spring connected between the first end of the swing plate and the bearing body wherein the coil spring biases the regulating member in the unlocking position; and the second end of the swing plate regulating the passage of the hinge pin within the pin insertion groove from the unlocking position to the released position.

Specifically, the swing plate biases a thrust rod bearing upon the first end of the swing plate adjacent the tension coil spring; and wherein activation of the thrust rod unbiases the regulating member allowing the hinge pin to pass from the closed end and the unlocking position to the open end and the release position.

The right-side and left-side door opening means for displacement of the regulating means each may have:

a first and second thrust rods having first and second ends respectively, the second end of the thrust rods bearing on, and springably biased by the regulating member;

the first and second cam, rotatably mounted within the door and about a first and second pins respectively, each cam having an offset diametrical portion and an axial projection;

a first and second bearing plate attached to the first end of the thrust rods, the bearing plates sidably contacting and biased against the diametrical projection of the cams; and an operating member for imparting rotational motion to the cams about the pins wherein the diametrical projections force the bearing plates and the thrust rods to displace the regulating members to the release position.

Preferably, the operating member comprises:

a handle portion connected to an operating portion wherein activation of the handle portion urges the operating portion against the axial projections causing rotation of the cams.

Moreover, the operating member is entirely recessed within the door and the handle portion is aligned in a biased position by a leaf spring.

BRIEF DESCRIPTION OF THE DRAWINGS

The invention will now be described, by way of example, with reference to the accompanying drawings, in which:

FIG. 4A is a horizontal sectional view showing a vicinity of a recess in the door and FIG. 4B is a vertical section of the arrangement of the unlocking member, a cam, a bearing plate, a thrust-up rod and a push-down rod shown in FIG. 4A and the relationship between a thrust-up rod, a push-down rod and the hinge mechanism in FIG. 4B.

FIGS. 5A and 5B are explanatory views showing the unlocking mechanism in an open door position according to the invention: FIG. 5A is a horizontal sectional view of the vicinity of the recess in the door and FIG. 5B is a vertical section of the arrangement of the unlocking member, the cam, the bearing plate, the thrust-up rod, the push-down rod and the relationship between the thrust-up rod, the push-down rod and the hinge mechanism.

DETAILED DESCRIPTION OF THE PREFERRED EMBODIMENT

This embodiment is an example in which the invention is applied to a refrigerator door.

Figure 1:
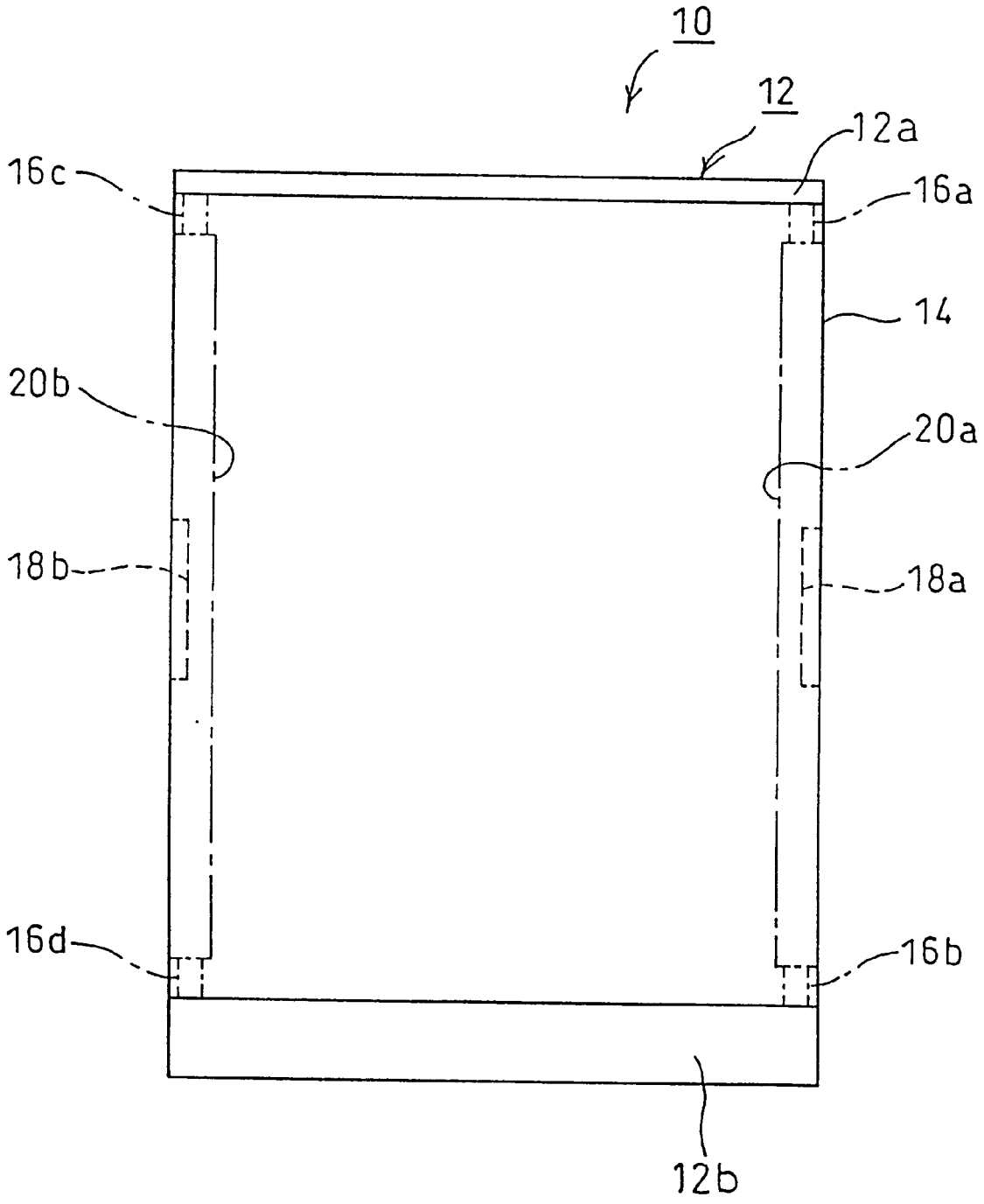
FIG. 1 is a front view of a refrigerator according to an embodiment of the invention.

As shown in FIG. 1, a refrigerator 10 is provided with a boxlike body 12 and a door 14 which is openably/closably attached to the body 12. The upper edge of the body 12 projects forward to form an upper edge portion 12*a*, while the lower edge of the body 12 projects forward to form a lower edge portion 12*b*. The door 14 is disposed between the upper edge portion 12*a* and the lower edge portion 12*b*. In the right and left sides of the door 14 formed are recesses 18*a* and 18*b* which are used for manually opening the door 14. On four corners of the door 14 are arranged hinge mechanisms 16*a*, 16*b*, 16*c* and 16*d* which constitute a part of the door operation mechanism according to the invention. Between the hinge mechanisms 16*a* and 16*b* is disposed a right unlocking mechanism 20*a* for operating the hinge mechanisms 16*a* and 16*b* to open the door to the right side, while between the hinge mechanisms 16*c* and 16*d* is disposed a left unlocking mechanism 20*b* for operating the hinge mechanisms 16*c* and 16*d* to open the door to the left side. Since the cooling mechanism of the refrigerator 10 and the shelve arrangements in the body 12 are well known, the illustration and description thereof are omitted.

The hinge mechanisms 16*a* to 16*d* will now be described. The hinge mechanisms 16*a* and 16*b* are vertically aligned. The hinge mechanisms 16*a* and 16*c* are horizontally symmetrical, while the hinge mechanisms 16*b* and 16*d* are horizontally symmetrical. The structure of the hinge mechanism 16*a*, representative of the hinge mechanisms 16*a* and 16*c*, is now described in detail, and the description of the similar hinge mechanisms 16*b* to 16*d* is omitted.

Figure 2A:
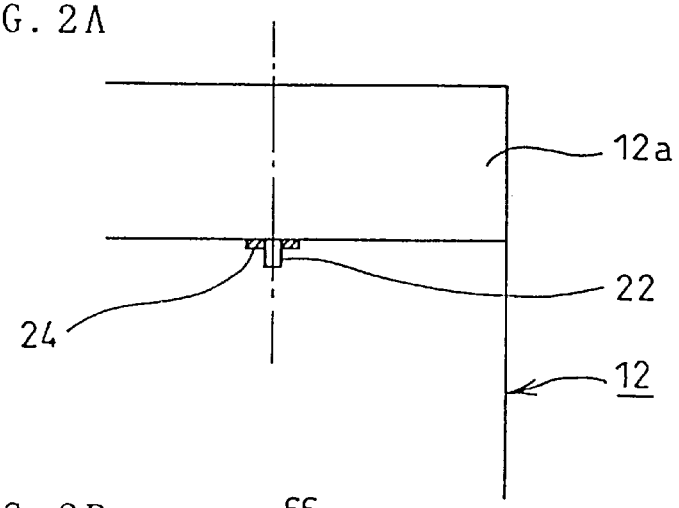
FIG. 2A is a front view of a hinge pin portion.

As shown in FIG. 2A, a hinge pin 22 is attached to the upper edge portion 12*a* of the body 12 and directed downward. An annular bearing member 24 is attached around the base portion of the hinge pin 22. As shown in FIGS. 4 and 5, a hinge pin 26 is built on the lower edge portion 12*b* along the same axial line as that of the hinge pin 22. A bearing member 28 is attached around the base portion of the hinge pin 26.

Figure 2B:
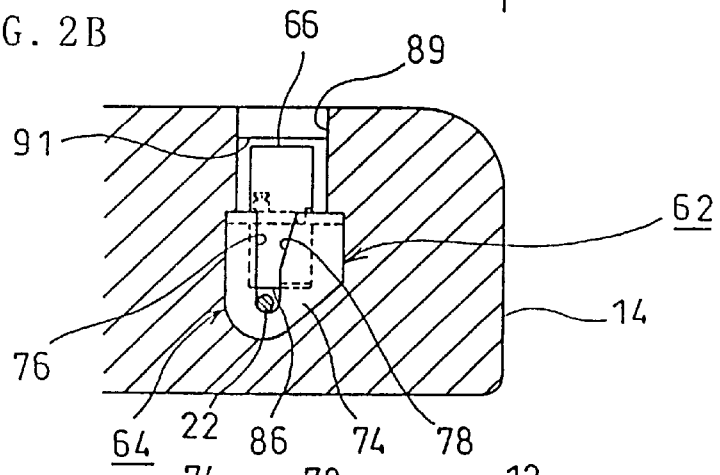
FIG. 2B is a plan view of a bearing portion.
Figure 2C:
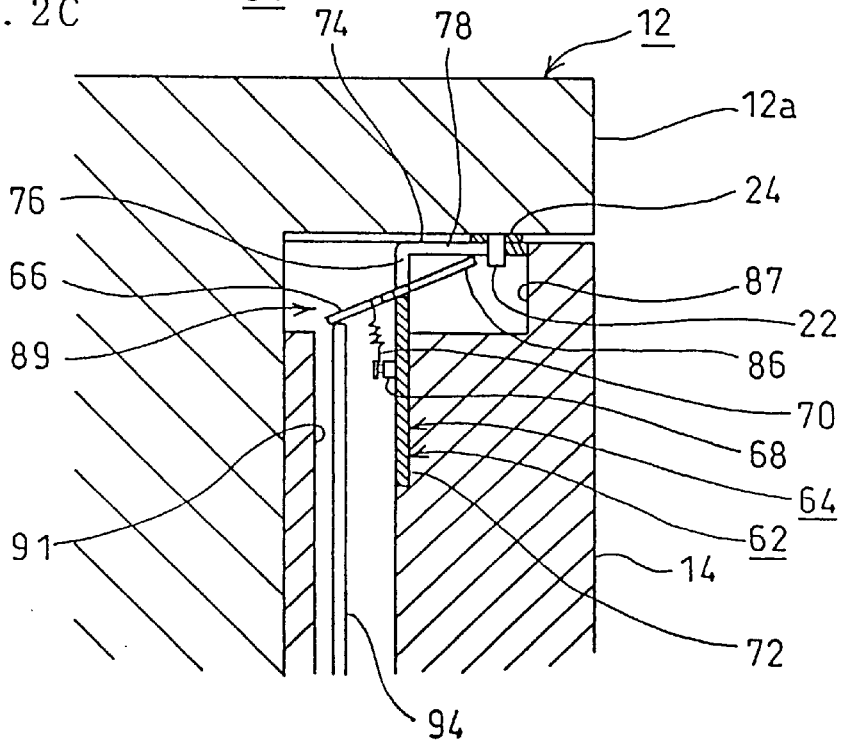
FIG. 2C is a sectional view of a vicinity of a hinge mechanism of the embodiment.

As shown in FIGS. 2B and 2C, on the door 14 a bearing 62 is provided for mounting the hinge pin 22 when the door 14 is closed. The bearing 62 is housed in the door 14. When the door 14 is closed, the hinge pin 22 passes through a pin insertion groove 78 of the bearing 62. The hinge pin 22 and the bearing 62 constitute the hinge mechanism 16*a*. The other hinge mechanisms 16*b* to 16*d* are constituted in the same manner.

As shown in FIG. 2C and FIGS. 3A to 3C, the bearing 62 is provided with an L-shaped bearing body 64, a swing plate 66 forming a regulating member and a tension coil spring 70 extended between a pin 68, mounted on the bearing body 64, and the swing plate 66.

In the bearing body 64, a hole 76 is formed by punching a vertical portion 72 and a horizontal portion 74 of the bearing body 64. A part of the hole 76 in the horizontal portion 74 forms the pin insertion groove 78. As shown in FIGS. 2B and 3C, the pin insertion groove 78 has substantially a U-shape which expands toward its open end or the vertical portion 72. As shown in FIG. 2C, the open end faces the body 12 of the refrigerator 10.

Figure 3A:
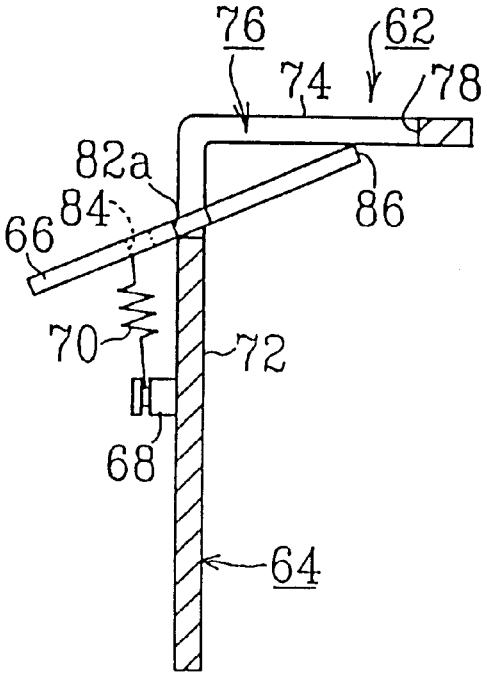
FIG. 3A is an enlarged sectional side view of a portion of FIG. 2C.
Figure 3B:
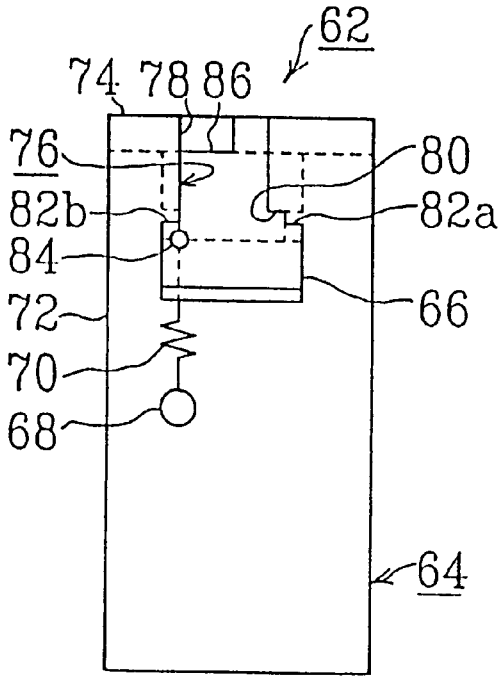
FIG. 3B is a front view of FIG. 3A.
Figure 3C:
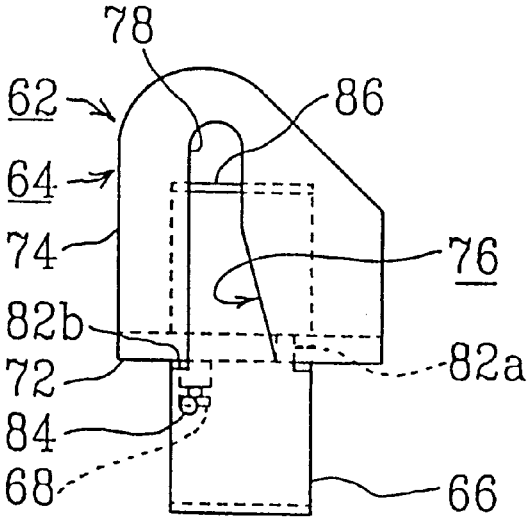
FIG. 3C is a plan view of a bearing in this embodiment.

As shown in FIG. 3B, in the hole 76, a stepped portion 80 is formed on one inner side of the vertical portion 72. The swing plate 66 is provided with a pair of U-shaped constricted portions 82*a* and 82*b*. By engaging the constricted portions 82*a* and 82*b* in the bottom portion of the hole 76, the swing plate 66 is inserted through the hole 76. Specifically, the constricted portion 82*a* of the swing plate 66 is engaged with the stepped portion 80, while the other constricted portion 82*b* is engaged with a part of the vertical portion 72. Also, the swing plate 66 has therein a spring mounting hole 84, to which one end of the tension coil spring 70 is connected. The swing plate 66 can swing on the bearing body 64 in the vicinity of the constricted portions 82*a* and 82*b*. The biasing force of the tension coil spring 70 allows a tip end 86 of the swing plate 66 to abut on the underside of the horizontal portion 74. As shown in FIGS. 2B and 3C, the tip end 86 of the swing plate 66 closes the pin insertion groove 78. Additionally, the constricted portion 82*a* prevents the swing plate 66 from coming off the bearing body 64.

As shown in FIG. 2C, in the door 14 is formed a recess 87 to allow the tip end 86 of the swing plate 66 to swing against the bias of the spring 70. On the opposite side of the recess 87 across the vertical portion 72 of the bearing 62, a recess 89 allowing passage of the hinge pin 22 opens toward the body 12. The lower portion of the recess 89 opens to a recess 91. A thrust-up rod 94 is inserted in the recess 91. The thrust-up rod 94 is axially liftably supported by a support member (not shown).

The right unlocking mechanism 20*a* and the left unlocking mechanism 20*b* will now be described. However, since the left unlocking mechanism 20*b* is horizontally symmetrical with the right unlocking mechanism 20*a*, only the right unlocking mechanism 20*a* will be described, and the description of the left unlocking mechanism 20*b* is omitted. In order to facilitate the understanding of the movement of the right unlocking mechanism 20*a* and the hinge mechanisms 16*a* and 16*b*, FIGS. 4B and 5B show the hinge mechanisms 16*a* and 16*b* rotated 90 degrees about a vertical axis from their usual orientation.

Figure 4A:
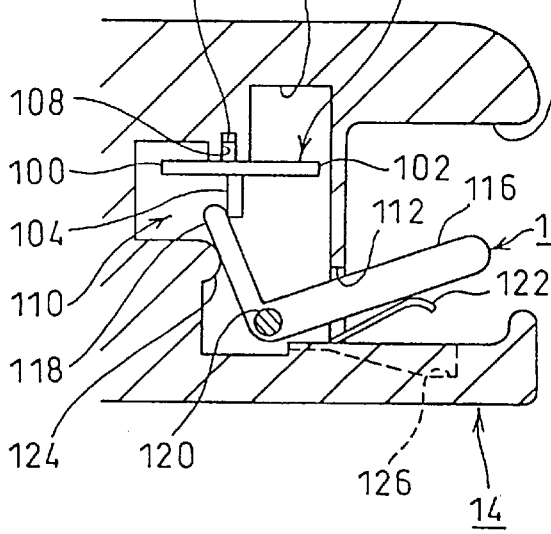
FIGS. 4A and 4B ate explanatory views of an unlocking mechanism in a closed door position according to the invention.
Figure 4B:
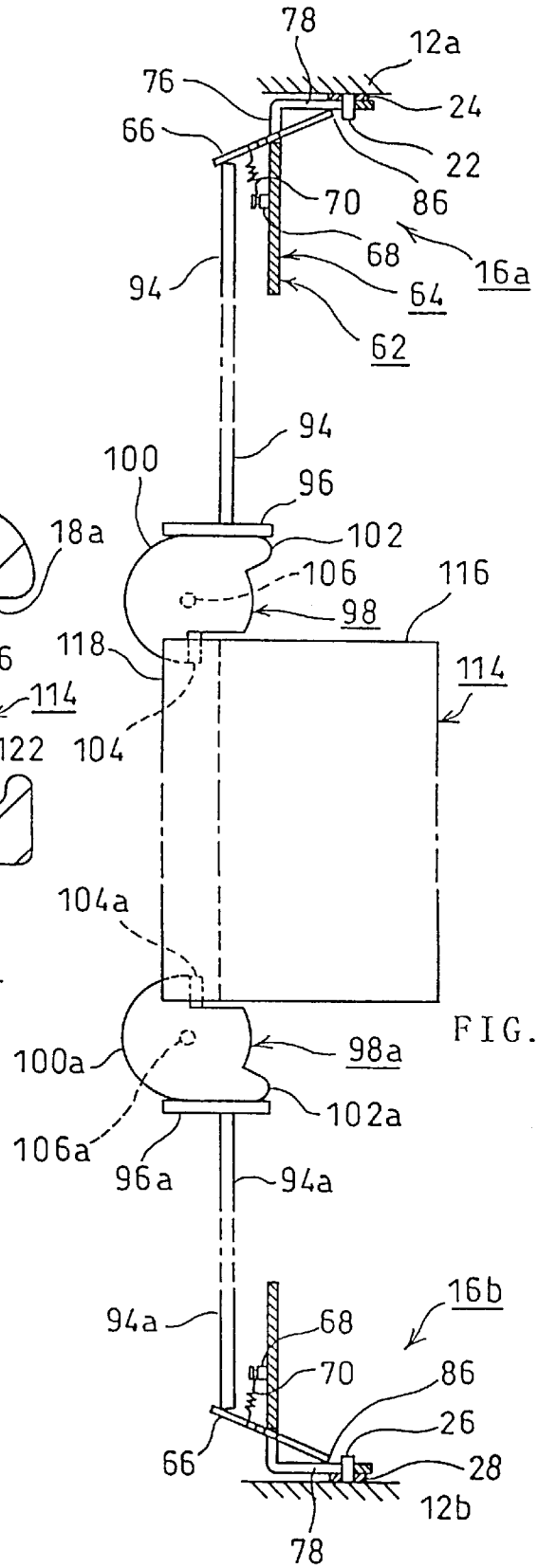

As shown in FIGS. 4B and 5B, a bearing plate 96 is attached to the lower end of the thrust-up rod 94. A cam 98 is disposed under the bearing plate 96. As shown also in FIGS. 4A and 5A, the cam 98 has a disk-like body portion 100, a diametrical projection 102 projected radially from the outer periphery of the body portion 100, an axial projection 104 projected perpendicularly from the body portion 100 and a pin 106 built on the rear face of the body portion 100. The pin 106 is rotatably supported in a bearing hole 108 formed in the door 14. The cam 98 can rotate about the pin 106.

A recess 110 in which the cam 98 is housed is connected via a through hole 112 to the recess 18*a*. An operating member 114 having an L-shaped cross section extends from the recess 110 to the recess 18*a*. The operating member 114 is constituted of a handle portion 116 projecting to the recess 18*a* and an operating portion 118 whose tip end abuts on the axial projection 104 of the cam 98. The operating member 114 is attached to the door 14 via a hinge pin 120 extending through a connecting portion of the handle portion 116 and the operating portion 118, and can pivot about this pin 120. A free end of a leaf spring 122 abuts on the rear face of the handle portion 116, while the other end of the leaf spring 122 is fixed to the door 14. The leaf spring 122 exerts its biasing force to the handle portion 116 of the operating member 114 in a counterclockwise direction (as seen in FIGS. 4A and 5A). However, as shown in FIG. 4A, since the operating portion 118 abuts on a rotation regulating protrusion 124 extending into the recess 110, the operating member 114 is prevented from being displaced counterclockwise further from the position shown in FIG. 4.

When an external force is applied to the handle portion 116, the operating member 114 is displaced in a clockwise direction (FIGS. 4A and 5A) against the biasing force of the leaf spring 122. In this case, as shown in FIG. 5A, when the handle portion 116 abuts on the inner face of the recess 18*a*, the operating member 114 cannot be displaced further in the clockwise direction. Additionally, n leaf spring 122 is housed in a recess 126 in the door 14, the swinging of the handle portion 116 is not inhibited by this spring.

Further, as shown in FIGS. 4B and 5B, under the operating member 114 there is provided a cam 98*a* which is vertically symmetrical with the cam 98. In the same a manner as the cam 98, the cam 98*a* is constituted of a disk-like body portion 100*a*, a diametrical projection 102*a* projected from the outer periphery of the body portion 100*a*, an axial projection 104*a* projected perpendicularly from the body portion 100*a* and a pin 106*a* built on the rear face of the body portion 100*a*. The pin 106*a* is rotatably supported in a bearing hole (not shown), and the cam 98*a* is thus attached to the door 14.

A bearing plate 96*a* abuts on the underside of the diametrical projection 102*a* of the cam 98*a*. In the same manner as the thrust-up rod 94, a push-down rod 94*a* is attached to the underside of the bearing plate 96*a*. The push-down rod 94*a* passes through a recess (not-shown) similar to the recess 91. The lower end of the push-down rod 94*a* abuts on the swing plate 66 of the hinge mechanism 16*b*. The push-down rod 94*a* is axially liftably held by a support member (not shown). A spring (not shown) exerts a biasing force upward or toward the cam 98*a*. Therefore, the bearing place 96*a* and the push-down rod 94*a* are prevented from pushing down the swing plate 66 by their weight.

The operation of the right unlocking mechanism 20*a* will be described with reference to FIGS. 4A, 4B, 5A and 5B. As aforementioned, in FIGS. 4B and 5B are shown the hinge mechanisms 16*a* and 16*b* displaced 90 degrees about the vertical axis.

In the right unlocking mechanism 20*a*, when no external force is exerted to the handle portion 116, as shown in FIG. 4A, the operating member 114 is displaced farthest in the counterclockwise direction. The diametrical projections 102 and 102*a* of the cams 98 and 98*a* are substantially horizontal. In this case, the thrust-up rod 94 is lowered while the push-down rod 94*a* is elevated.

Here, when a force is exerted on handle portion 116, in the direction in which the door 14 is opened, the handle portion 116 is pivoted clockwise and the axial projections 104 and 104*a* of the cams 98 and 98*a* are pushed, respectively, by the operating portion 118, and the cam 98 is rotated in the counterclockwise direction while the cam 98*a* is rotated in the clockwise direction. Correspondingly, the diametrical projection 102 pushes up the thrust-up rod 94 together with the bearing plate 96 and diametrical projection 102*a* pushes down the push-down rod 94*a* together with the bearing plate 96*a*. The pushed up thrust-up rod 94 pushes the swing plate 66 of the hinge mechanism 16*a*, thereby swinging and displacing downward the tip end 86 of the swing plate 66. Also, the pushed down pushdown rod 94*a* pushes the swing plate 66 of the hinge mechanism 16*b*, thereby swinging and displacing upward the tip end 86 of the swing plate 66. The swing plates 66 of the hinge mechanisms 16*a* and 16*b* are thus released from the hinge pins 22 and 26, and the right side of the door 14 is freed from the body 12 to permit the door 14 to be opened on an axis formed by the left-side hinge mechanisms 16*c* and 16*d*.

In the same manner, when the left unlocking mechanism 20*b* is operated with the fingers in the recess 18*b* in the left side, the door 14 is disconnected from the body 12 by the hinge mechanisms 16*c* and 16*d*. The door 14 can be opened on an axis formed by the right-side hinge mechanisms 16*a* and 16*b*.

Subsequently, when the opened door 14 is swung in a closing direction, the vertically opposed hinge pins 22 and 26 on which the door has been opened are relatively moved from the open ends of the pin insertion grooves 78 toward the closed ends thereof, respectively. The hinge pins 22 and 26 press the swing plates 66 to displace the tip ends 86 of the swing plates 66 against the biasing forces of the tensile coil springs 70 toward the release position, and simultaneously pass the open ends of the pin insertion grooves 78 toward the closed ends thereof When the hinge pins 22 and 26 are moved to the closed ends of the pin insertion grooves 78, the swing plates 66 are returned to the original positions via the biasing forces of the tensile coil springs 70 until the tip ends 86 thereof abut on the horizontal portions 74. Therefore, the hinge pins 22 and 26 pass toward the closed ends of the pin insertion grooves 78 and are inhibited from moving toward the open ends, and the door 14 is closed. When the door 14 is opened to the left side, it can be closed in the same manner.

Additionally, by simultaneously operating the right and left unlocking mechanisms 20*a* and 20*b*, the connection of the body 12 and the door 14 by means of the hinge mechanisms 16*a*, 16*b*, 16*c* and 16*d* can be released. The door 14 can thus be detached from and removed from the body 12.

Figure 6C:
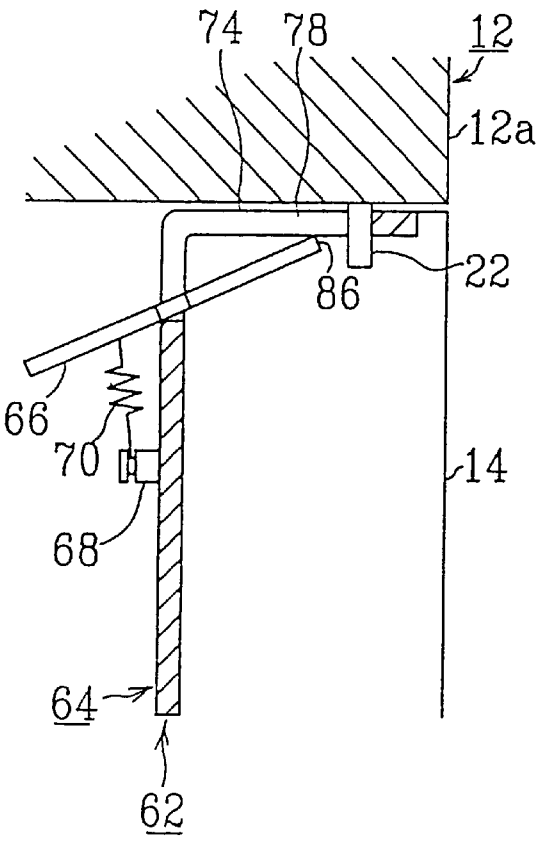
FIGS. 6A to 6C are explanatory views showing the starting of attaching, the attaching, and the completion of the attaching of the door onto the refrigerator, respectively.
Figure 6B:
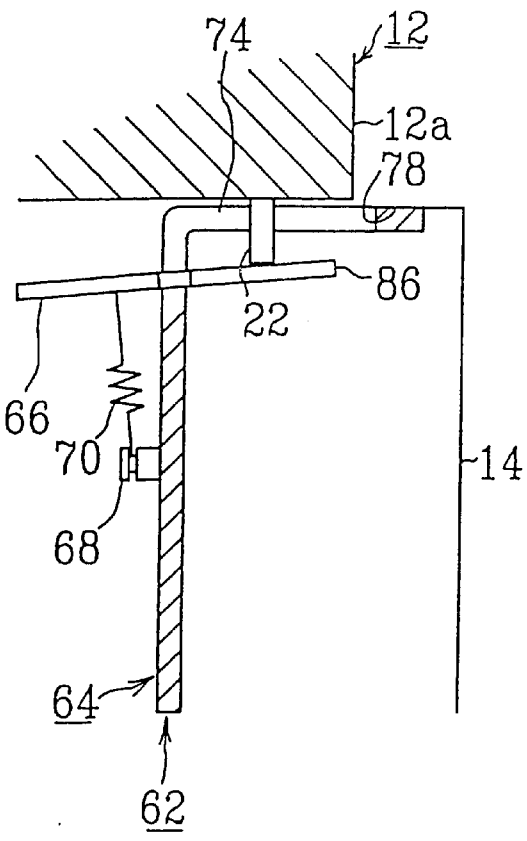
Figure 6A:
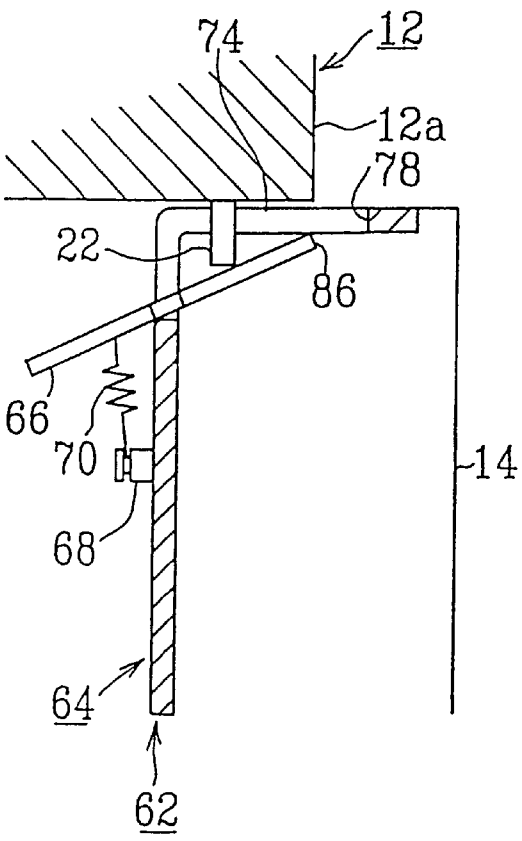

When the door 14 is attached to the body 12 during manufacture or following detachment is attached to the body 12, as shown in FIG. 6A, for example, in the hinge mechanism 16*a*, with the hinge pin 22 into the pin insertion groove 78, the door 14 is moved in parallel with and toward the body 12. Then, the hinge pin 22 contacts the swing plate 66 and swings/displaces the swing plate 66 against the biasing force of the tensile coil spring 70 until the tip end 86 is lowered, as shown in FIG. 6B. When the door 14 is moved closer to the body 12, the hinge pin 22 passes along the swing plate 66 and reaches the end of the pin insertion groove 78.

Subsequently, the swing plate 66 released from the hinge pin 22 has its tip end 86 elevated by the biasing force of the tensile coil spring 70. As shown in FIG. 6C, the tip end 86 abuts on the underside of the horizontal portion 74. Thereby, since the tip end 86 closes the pin insertion groove 78, the hinge pin 22 is prevented from being moved to the open end of the pin insertion groove 78. At the same time, the other hinge mechanisms 16*b* to 16*d* operate similarly. The door 14 is thus attached to the body 12.

While the preferred embodiment of the invention has been described, it is to be understood that the invention is not limited thereto, and may be otherwise embodied within the scope of the following claims.

For example, in the embodiment, the invention is applicable to the refrigerator door, but also can be applied to a door for use in a locker, wardrobe or other furniture.

Also, in order to displace the regulating member toward the release position, in the embodiment, the thrust-up or push-down rod is used. Alternatively, by using a wire or the like, the regulating member can be pulled or displaced toward the release position.

Further, the structure for transmitting the force of displacing the regulating member to the rod, the wire or the like is not restricted to the aforementioned embodiment, and can be embodied variously.

Also in the embodiment, the swing plate 66 is swung vertically, but the regulating member can be swung horizontally. The latter regulating member will be described as first and second modifications with reference to FIGS. 7A to 7C and 8A to 8C.

Figure 7A:
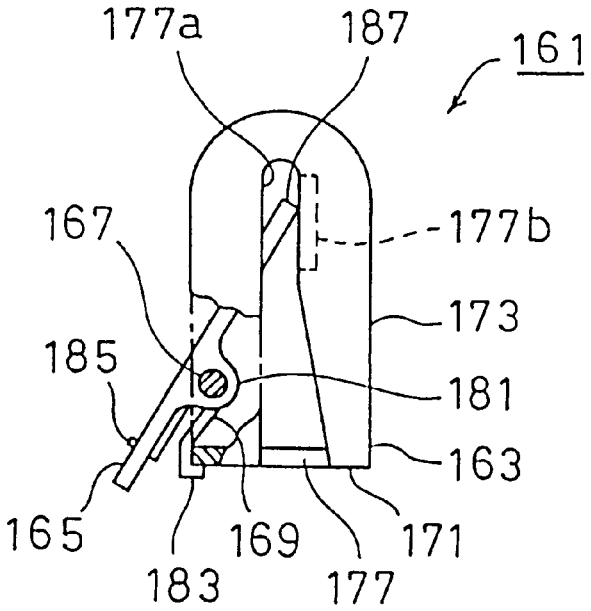
FIG. 7A is,a partial broken plan view of a bearing structure in a first modification.
Figure 7B:
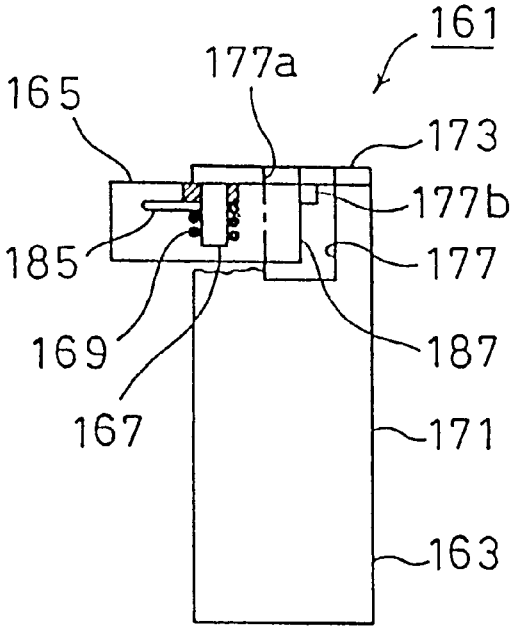
FIG. 7B is a partial broken front view thereof.
Figure 7C:
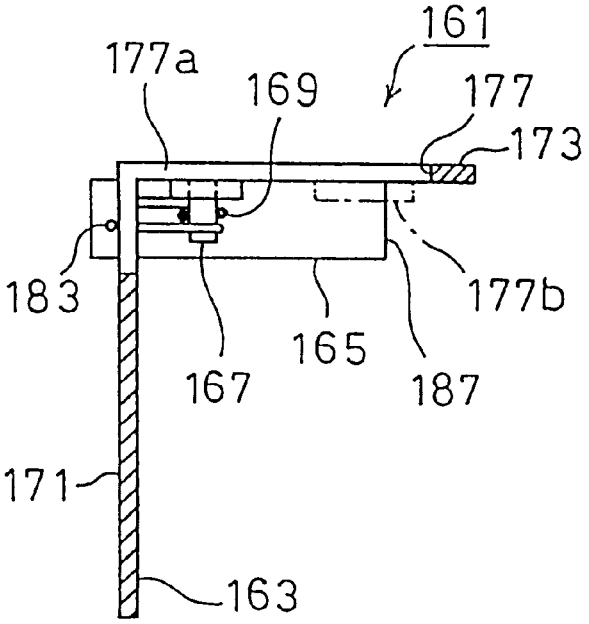
FIG. 7C is a sectional side view thereof.

As shown in FIGS. 7A to 7C, a bearing 161 consists of an L-shaped body 163, a swing plate 165 as the regulating member, a pin 167 built on the swing plate 165, and a torsion coil spring 169 as a biasing member which is attached to the pin 167 with a play.

The body 163 is provided with a punched hole 177 which extends from a vertical portion 171 to a horizontal portion 173. A portion of the punched hole 177 in the horizontal portion 173 forms a pin insertion groove 177*a*. The pin insertion groove 177*a* substantially has a U-shape which is expanded toward its inlet end or toward the vertical portion 171. The inlet end is directed to a hinge pin (not shown). On the underside of the horizontal portion 173 is provided a stopper 177*b* which is extended along one edge of the pin insertion groove 177*a*.

The swing plate 165 is provided with a bearing portion 181 for passing the pin 167, and can swing around the pin 167. One end 183 of the torsion coil spring 169 is engaged with the vertical portion 171 of the body 163, while the other end 185 thereof is passed through the swing plate 165.

The biasing force of the torsion coil spring 169 usually allows a tip end 187 of the swing plate 165 to abut on the stopper 177*b* . In this case, as shown in FIG. 7A, the tip end 187 of the swing plate 165 closes the pin insertion groove 177*a*.

In the structure described above, when the door 14 is attached to the body 12 with the hinge pin inserted in the pin insertion groove 177*a*, the door 14 is moved in parallel toward the body 12. Then, the hinge pin contacts the swing plate 165 and swings/displaces the swing plate 165 against the biasing force of the torsion coil spring 169. The tip end 187 is swung and displaced in a counterclockwise direction as seen in FIG. 7A. When the door 16 is further moved to substantially contact the body 12, the hinge pin passes along the swing plate 165 and reaches the end of the pin insertion groove 177*a*. Subsequently, the swing plate 165 released from the hinge pin is swung clockwise via the biasing force of the torsion coil spring 169 until the tip end 187 abuts on the stopper 177*b* . Thereby, the tip end 187 closes the pin insertion groove 177*a*. The hinge pin is thus prevented from moving toward the open end of the pin insertion groove 177*a*. At the same time, the other hinge mechanisms operate similarly. The door 14 is thus attached to the body 12.

By using the mechanism for swinging/displacing the swing plate 165 in the counterclockwise direction as seen in FIG. 7A when a force of opening the door 14 is applied, the door 14 can be opened to either side.

Figure 8A:
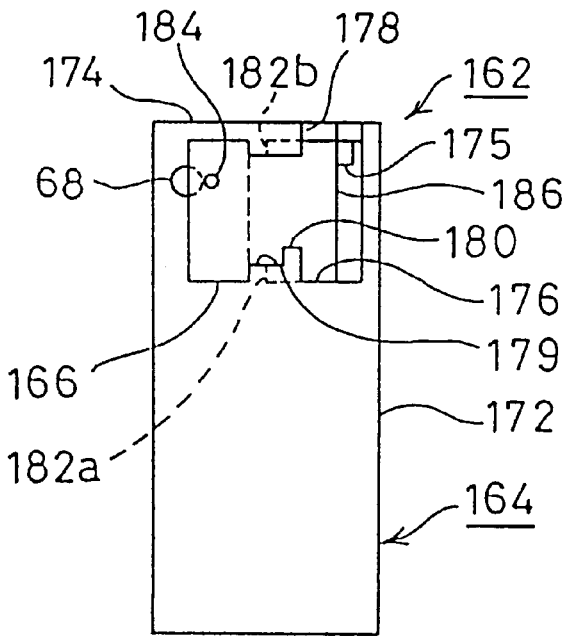
FIG. 8A is a front view of a bearing structure in a second modification.
Figure 8B:
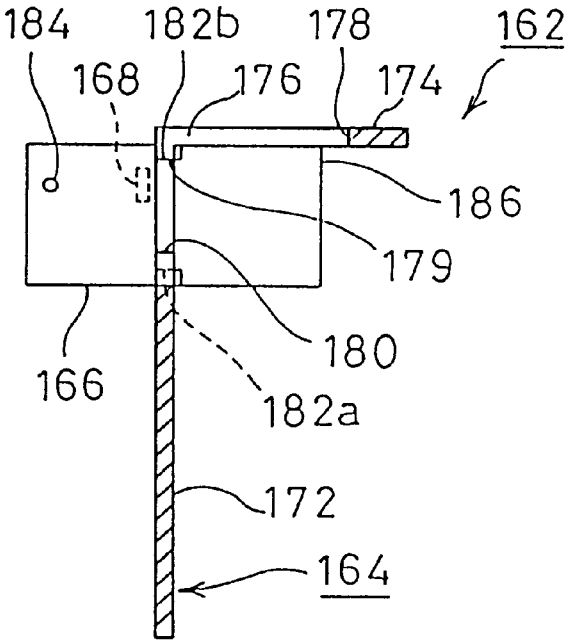
FIG. 8B is a sectional side view thereof.
Figure 8C:
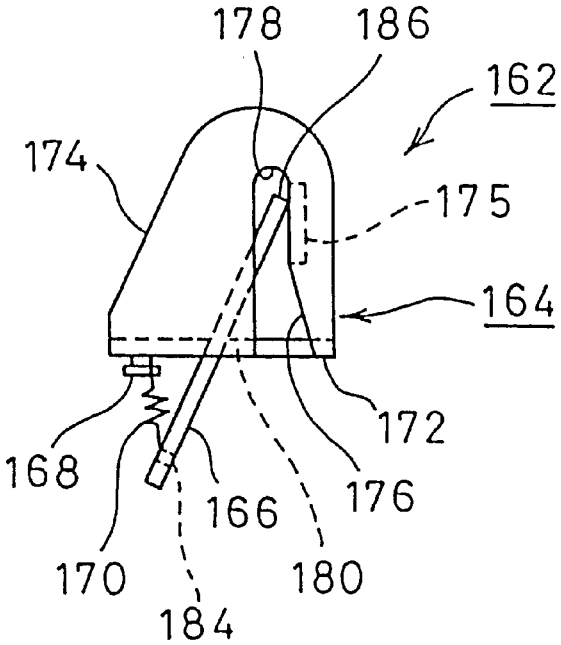
FIG. 8C is a plan thereof.

As shown in FIG. 8A to 8C, a bearing 162 consists of an L-shaped body 164, a swing plate 166 as the regulating member, a pin 168 built on the body 164, and a tension coil spring 170 as a biasing member which is extended between the pin 168 and the swing plate 166.

The body 164 is provided with a punched hole 176 which extends from a vertical portion 172 to a horizontal portion 174. A portion of the punched hole 176 in the horizontal portion 174 forms a pin insertion groove 178. The pin insertion groove 178 substantially has a U-shape which is expanded toward its inlet end or toward the vertical portion 172. The inlet end is directed to a hinge pin (not shown). On the underside of the horizontal portion 174 is provided a stopper 175 which is extended along one edge of the pin insertion groove 178. In a portion of the punched hole 176 in the vertical portion 172 is provided a plate support potion 179 which extends transversely. A stepped portion 180 is formed on the lower side of the plate support potion 179.

The swing plate 166 is provided with a pair of U-shaped constricted portions 182*a* and 182*b*. By engaging the constricted portions 182*a* and 182*b* in the plate support portion 179 of the hole 176, the swing plate 166 is inserted through the hole 176. Specifically, the constricted portion 182*a* of the swing plate 166 is engaged with the stepped portion 180, while the other constricted portion 182*b* is passed along the edge in the punched hole 176. Also, the swing plate 166 has therein a spring hole 184, to which one end of the tension coil spring 170 is connected. Therefore, the swing plate 166 can swing horizontally on a support which is in the vicinity of the constricted portions 182*a* and 182*b*. The biasing force of the tension coil spring 170 usually allows a tip end 186 of the swing plate 166 to abut on the stopper 175. In this case, as shown in FIG. 8C, the tip end 186 of the swing plate 166 closes the pin insertion groove 178. Additionally, the constricted portion 182*a* prevents the swing plate 166 from coming off the body 164.

In the structure described above, when the door 14 is attached to the body 12, in the same manner as the embodiment, with the hinge pin inserted in the pin insertion groove 178, the door 14 is moved in parallel toward the body 12. Then, the hinge pin contacts the swing plate 166 and swings/displaces the swing plate 166 against the biasing force of the tension coil spring 170. The tip end 186 is swung and displaced in a counterclockwise direction as seen in FIG. 8C. When the door 16 is further moved to substantially contact the body 12, the hinge pin passes along the swing plate 166 and reaches the end of the pin insertion groove 178. Subsequently, the swing plate 166 released from the hinge pin is swung clockwise via the biasing force of the tension coil spring 170 until the tip end 186 abuts on the stopper 175. Thereby, the tip end 186 closes the pin insertion groove 178. The hinge pin is thus prevented from moving toward the open end of the pin insertion groove 178. At the same time, the other hinge mechanisms operate similarly. The door 14 is thus attached to the body 12.

Additionally, in the same manner as the unlocking mechanism of the embodiment, by using the mechanism for swinging/displacing the swing plate 166 in the counterclockwise direction as seen in FIG. 8C when the force of opening the door 14 is applied, the door 14 can be opened to either side in the same manner as the embodiment.

What is claimed is:

1. A door operating mechanism for opening and closing a door relative to a structure, said structure defining two pairs vertically opposed hinge pins defining two hinge axes, with one hinge pin on each of a right side and a left side of said structure, said door comprising:

four bearing latch assemblies, ones for each said hinge pin; each of said bearing latch assemblies having a pin insertion groove of a sufficient width for facilitating passage of a said hinge pin therein; and each said pin insertion groove having an open end adjacent said structure and a closed end remote from said structure;

each said bearing latch assembly having a regulating member provided in the pin insertion grooves, each said regulating member being displaceable between an unlocking position in which the associated hinge pin passes through the closed end of the pin insertion groove and is prevented from moving toward said open end thereof, and a release position in which said hinge pin is free to move toward said open end, each said regulating member being biased into said unlocking position by a biasing member, and each said regulating member being displaced by said hinge pin, when there is relative movement of said hinge pin from said open end toward said closed end, to said release position against a biasing force of said biasing member to allow said hinge pin to pass along said pin insertion groove toward the closed end thereof;

a right-side door opening means being provided on the right side of said door displaceable from a closed door position to an opened door position, by an external force for opening said door, to displace the regulating members provided on said right side of the door to said release position;

a left-side door opening means being provided on the left side of said door displacable from the closed door position to the opened door position, by the external force for opening said door, to displace the regulating members provided on said left side of the door to said release position;

a bearing body defining said pin insertion groove;

said regulating member being a swing plate having a first end and a second end, said swing plate being pivotally supported by said bearing body within said pin insertion groove;

said biasing member being a tension coil spring connected between said first end of said swing plate and said bearing body so that said coil spring biases said regulating member into said unlocking position; and said second end of said swing plate regulating the passage of said hinge pin within said pin insertion groove from said unlocking position to said released position.

2. The door operating mechanism according to claim 1, wherein said swing plate biases a thrust rod bearing upon said first end of said swing plate adjacent said tension coil spring; and activation of said thrust rod unbiases said regulating member thereby allowing said hinge pin to pass from said closed end and said unlocking position to said open end and said release position.

3. The door operating mechanism according to claim 1, wherein each of said right-side door opening means and said left-side door opening means comprises:

a first thrust rod and a second thrust rod which have first and second ends respectively, said second end of said thrust rods bearing on and are springably biased by said regulating member;

a first cam and a second cam, rotatably mounted within said door and about a first and second pins respectively, each of said first and second cams having an offset diametrical portion and an axial projection;

a first bearing plate and a second bearing plate attached to said first end of said thrust rods, said first and second bearing plates slidably contacting and are biased against said diametrical projection of said cams; and an operating member for imparting rotational motion to said first and second cams about said pins so that said diametrical projections force said first and second bearing plates and said thrust rods to displace said regulating members to said release position.

4. The door operating mechanism according to claim 3, wherein the operating member comprises:

a handle portion connected to an operating portion so that activation of said handle portion urges said operating portion against said axial projections thereby causing rotation of said first and second cams.

5. The door operating mechanism according to claim 4, wherein said operating member is entirely recessed within said door and said handle portion is aligned in a biased position by a leaf spring.

6. A door operating mechanism for one of fastening and unfastening a door encompassing a doorway of a structure, the door operating mechanism comprising:

two pairs of vertically aligned hinge pins, one said pair of vertically aligned hinge pins being supported on a left side of said doorway and the other said pair of vertically aligned hinge pins being supported on a right side of said doorway;

two pairs of bearing latch assemblies, each pair being supported on the left side and the right side of said door, each said bearing latch assembly having a bearing body defining a pin insertion groove for cooperatively engaging one of said hinge pins, said pin insertion groove having a sufficient width for passage of said hinge pin therethrough, an open end adjacent said structure and a closed end remote from said structure;

a regulating member being provided in the pin insertion grooves, each said regulating member being displaceable between an unreleased position in which the cooperatively engaged hinge pin is prevented from passing through said open end thereof by said regulating member, and a release position in which said hinge pin freely passes through said open end;

a right-side door opening means being provided on the right side of said door for displacing the regulating members provided on said right side of the door between said unreleased position and said release position; and a left-side door opening means being provided on the left side of said door for displacing the regulating members provided on said left side of the door between said unreleased position and said release position;

wherein said regulating member is a swing plate having a first end and a second end, and a tension coil spring is connected between said first end of said swing plate and said bearing body to pivotally bias said second end of said swing plate against said groove retaining said hinge pin within said pin insertion groove in the unreleased position.

* * * * *